US006684829B2

(12) United States Patent
Gebauer et al.

(10) Patent No.: US 6,684,829 B2
(45) Date of Patent: Feb. 3, 2004

(54) DEVICE TO ACTUATE A GAS SHUTTLE VALVE IN AN INTERNAL COMBUSTION ENGINE

(75) Inventors: Klaus Gebauer, Seelze (DE); Stefan Kellermann, Barsinghausen (DE)

(73) Assignee: TRW Deutschland GmbH, Barsinghausen (DE)

( * ) Notice: Subject to any disclaimer, the term of this patent is extended or adjusted under 35 U.S.C. 154(b) by 0 days.

(21) Appl. No.: 10/161,424

(22) Filed: Jun. 3, 2002

(65) Prior Publication Data

US 2002/0185090 A1 Dec. 12, 2002

(30) Foreign Application Priority Data

Jun. 8, 2001 (DE) ..... 201 09 597

(51) Int. Cl.[7] ..... F01L 9/04
(52) U.S. Cl. ..... 123/90.11; 123/90.15
(58) Field of Search ..... 123/90.11, 90.15

(56) References Cited

U.S. PATENT DOCUMENTS 4,515,343 A * 5/1985 Pischinger et al. ..... 251/48
5,692,463 A * 12/1997 Liang et al. ..... 123/90.11
5,762,035 A * 6/1998 Schebitz ..... 123/90.11
6,070,853 A 6/2000 Stolk et al.

FOREIGN PATENT DOCUMENTS

| | | | |
|---|---|---|---|
| DE | 3911496 | A1 | 10/1990 |
| DE | 4300666 | A1 | 7/1993 |
| DE | 19739539 | A1 | 3/1999 |
| DE | 19935871 | A1 | 2/2001 |
| EP | 0471614 | A1 | 2/1992 |
| JP | 1089029 | | 4/1998 |

* cited by examiner

*Primary Examiner*—Thomas Denion
*Assistant Examiner*—Jaime Corrigan
(74) *Attorney, Agent, or Firm*—Tarolli, Sundheim, Covell & Tummino L.L.P.

(57) ABSTRACT

A device for the actuation of a gas shuttle valve in an internal combustion engine that allows an optimization of both engine performance and fuel consumption by providing a variable valve lift. The lift of the gas shuttle valve can be varied by adjusting the effective axial distance of the actuators. As needed, the valve lift is increased or decreased in order to either improve engine performance or fuel consumption.

13 Claims, 9 Drawing Sheets

DEVICE TO ACTUATE A GAS SHUTTLE VALVE IN AN INTERNAL COMBUSTION ENGINE

FIELD OF INVENTION

The present invention relates to a device to actuate a gas shuttle valve in an internal combustion engine.

BACKGROUND OF THE INVENTION

In internal combustion engines that use a valve drive without a camshaft of the type described, for example, in DE 199 35 871 A1, each valve is actuated by two actuators that act in an axial direction (the direction of the valve stem) and in directions opposite each other. Return springs that engage the valve shaft and that likewise act in directions opposite each other bias the valve to a neutral idle position between a valve open position and a valve closed position. Electromagnetic actuators have a magnet yoke and an anchor plate coupled to the valve stem. The valve lift is determined by the sum of the strokes of the two actuators. The stroke of each actuator is, in turn, determined by abutment of the anchor plate on the respective magnet yoke. In conventional valve drives, the valve lift is a compromise between the engine performance and the fuel consumption.

BRIEF SUMMARY OF THE INVENTION

The invention provides a device for the actuation of a gas shuttle valve in an internal combustion engine that allows an optimization of both engine performance and fuel consumption by providing a variable valve lift. According to the invention, the lift of the gas shuttle valve can be varied by adjusting the effective axial distance of the actuators. As needed, the valve lift is increased or decreased in order to either improve engine performance or fuel consumption. Preferably, the valve lift is changed continuously so that a very precise adaptation to the operating conditions of the engine is ensured.

The axial distance between the actuators can be varied very simply with a slide or wedge that can be moved perpendicularly to the axial direction of the valve stem. The slide or wedge has a ramp surface on which one of the actuators bears axially. When electromagnetic actuators are used, the axial distance between the pole surface on the yoke of the one actuator and the pole surface of the other actuator is varied. The slide or wedge can be actuated by a simple hydraulic, mechanical or electromagnetic actuating drive.

In preferred embodiments of the invention, the spring force of the return spring is adapted to the variable valve lift. For this purpose, the axial position of the return spring support is adjusted. Such adjustment is preferably carried out synchronously with adjustment of the valve lift, especially by means of the same actuating drive. In order for the return force in the closed position of the valve to be independent of the magnitude of the valve lift, the bias of the return spring is reduced when the valve lift is increased and the bias of the return spring is increased when the valve lift is decreased.

BRIEF DESCRIPTION OF THE DRAWINGS

Additional features and advantages of the invention ensue from the following description of several embodiments with reference to the accompanying drawings. The following is shown in the drawings:

DETAILED DESCRIPTION OF PREFERRED EMBODIMENT

Figure 1:
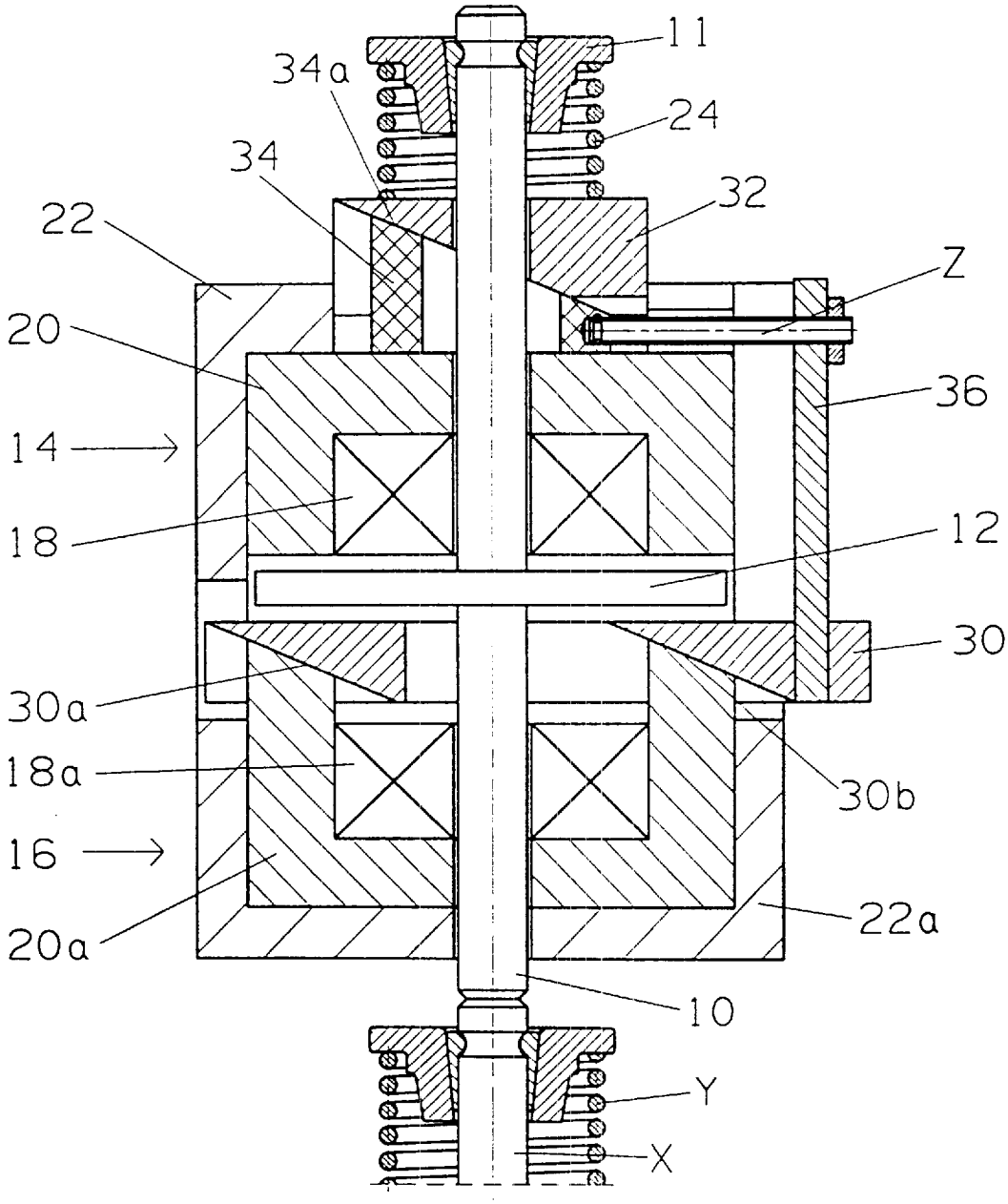
Figure 2:
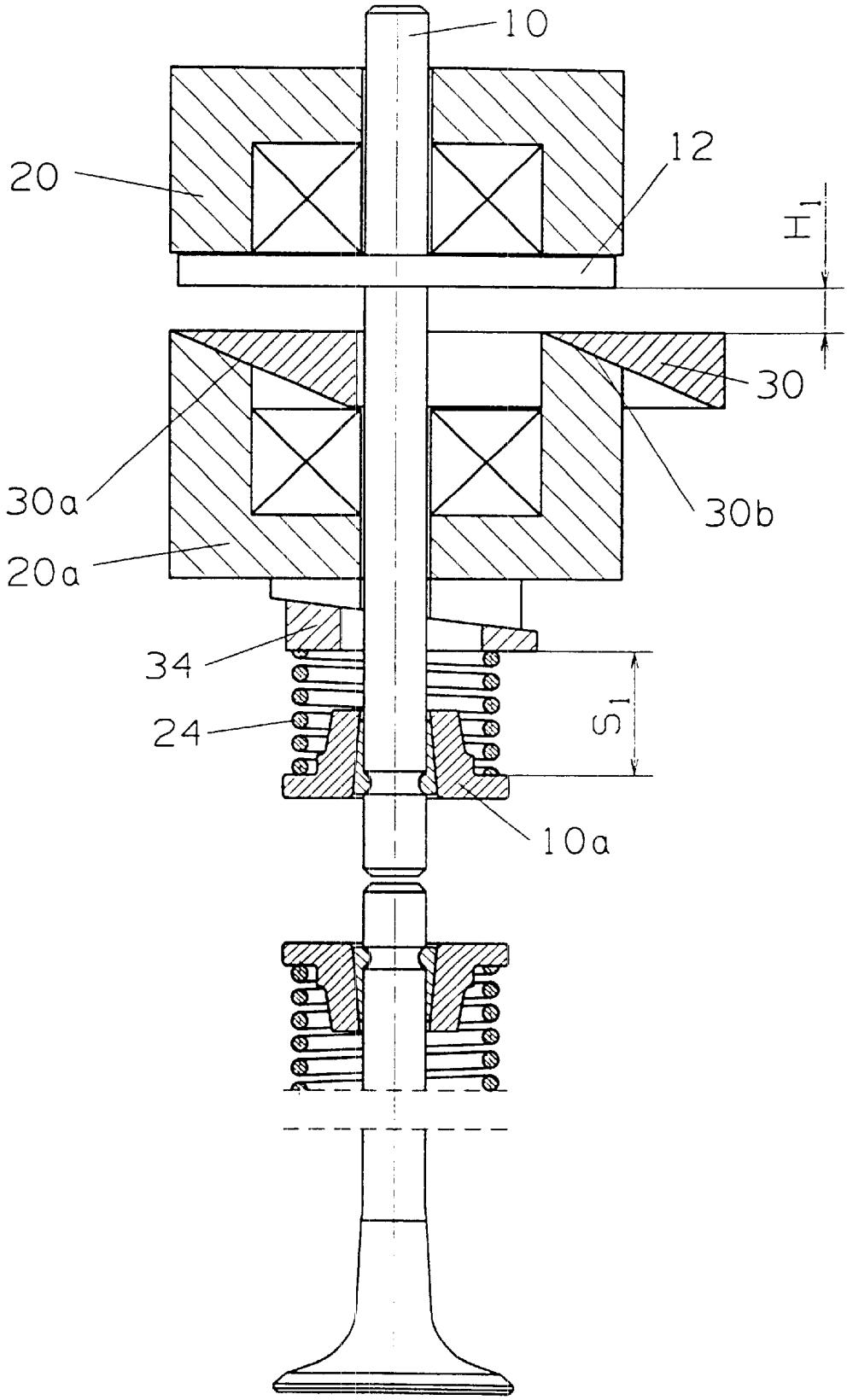
Figure 3:
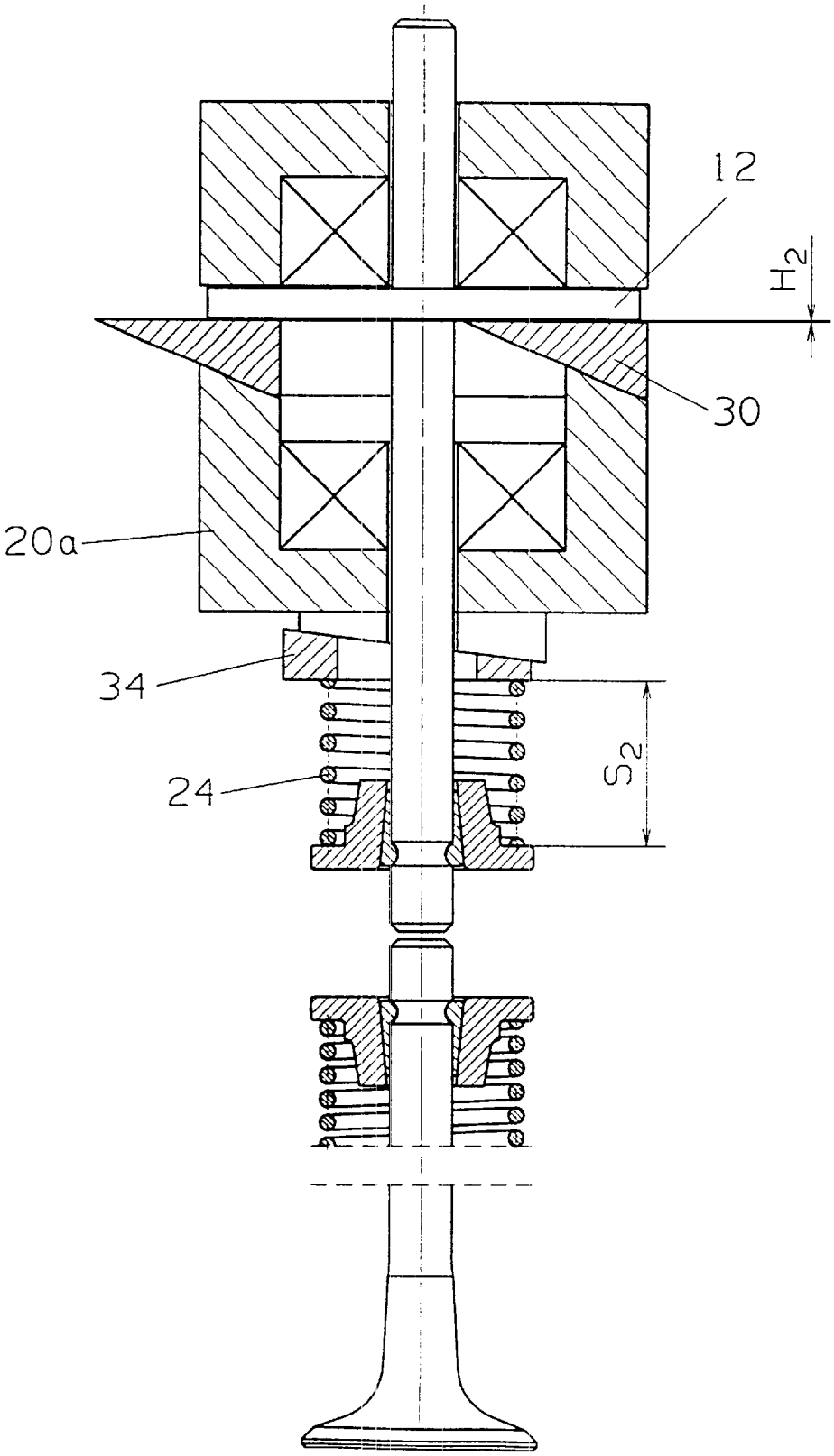
Figure 4:
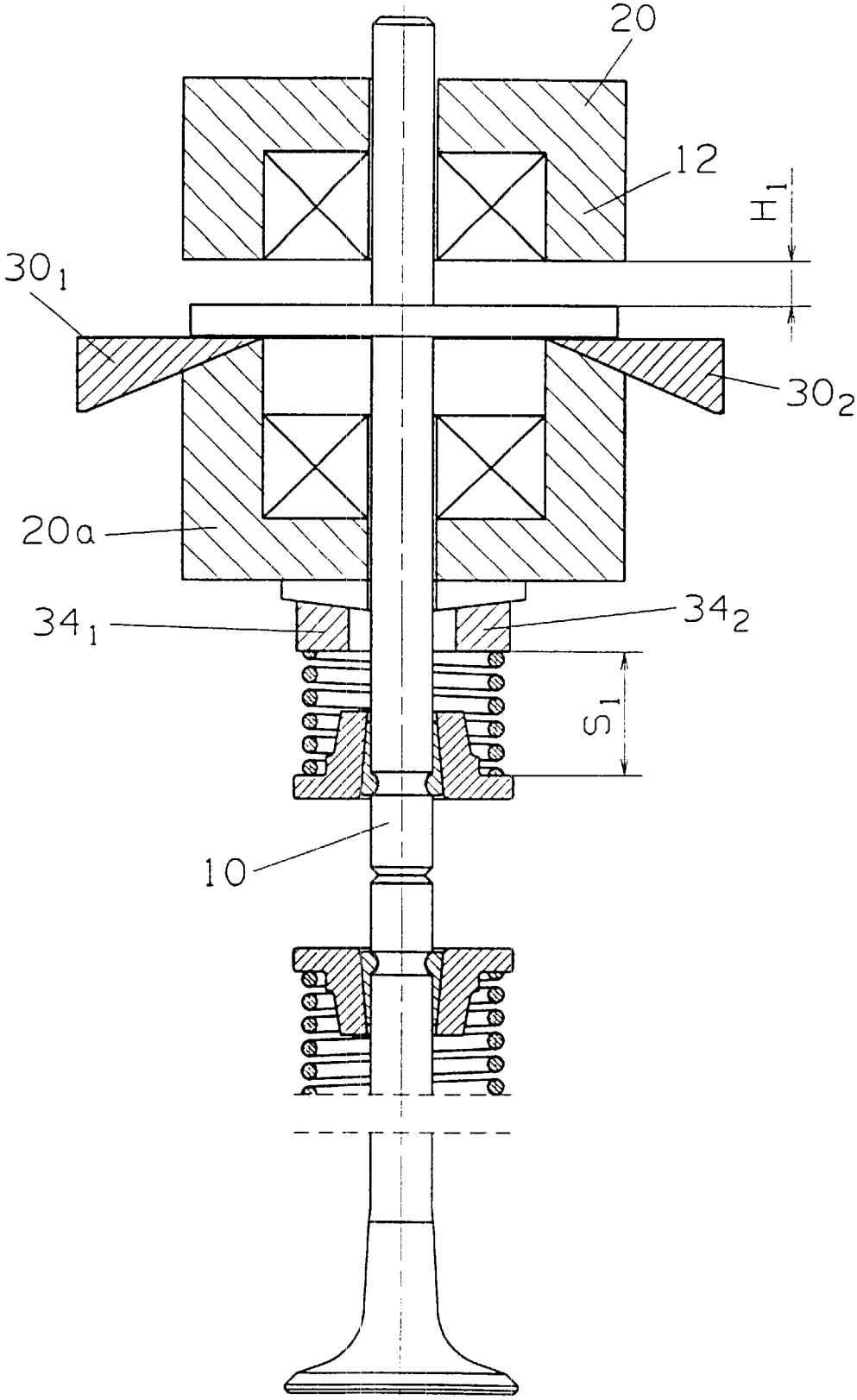
Figure 5:
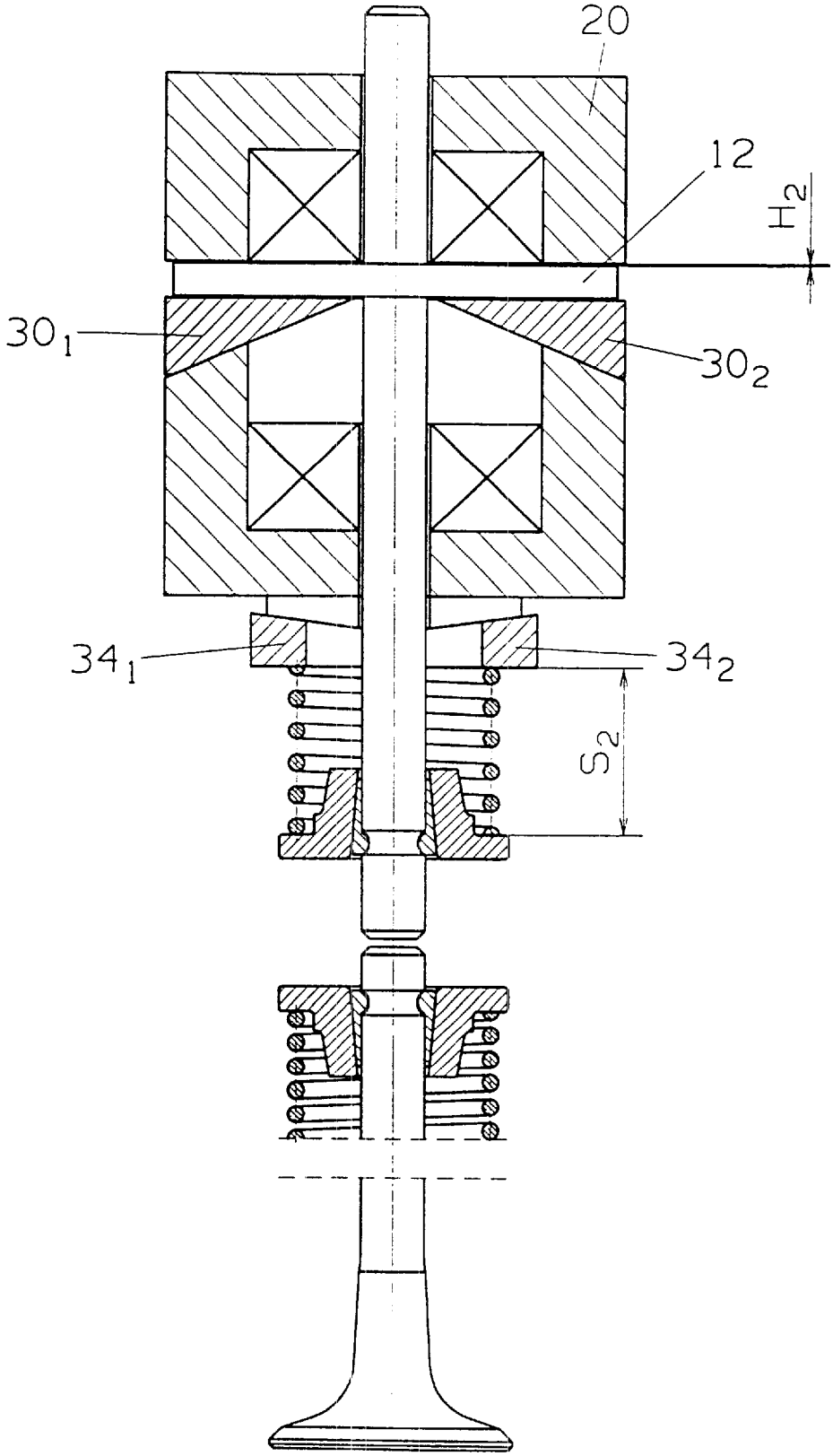
Figure 6:
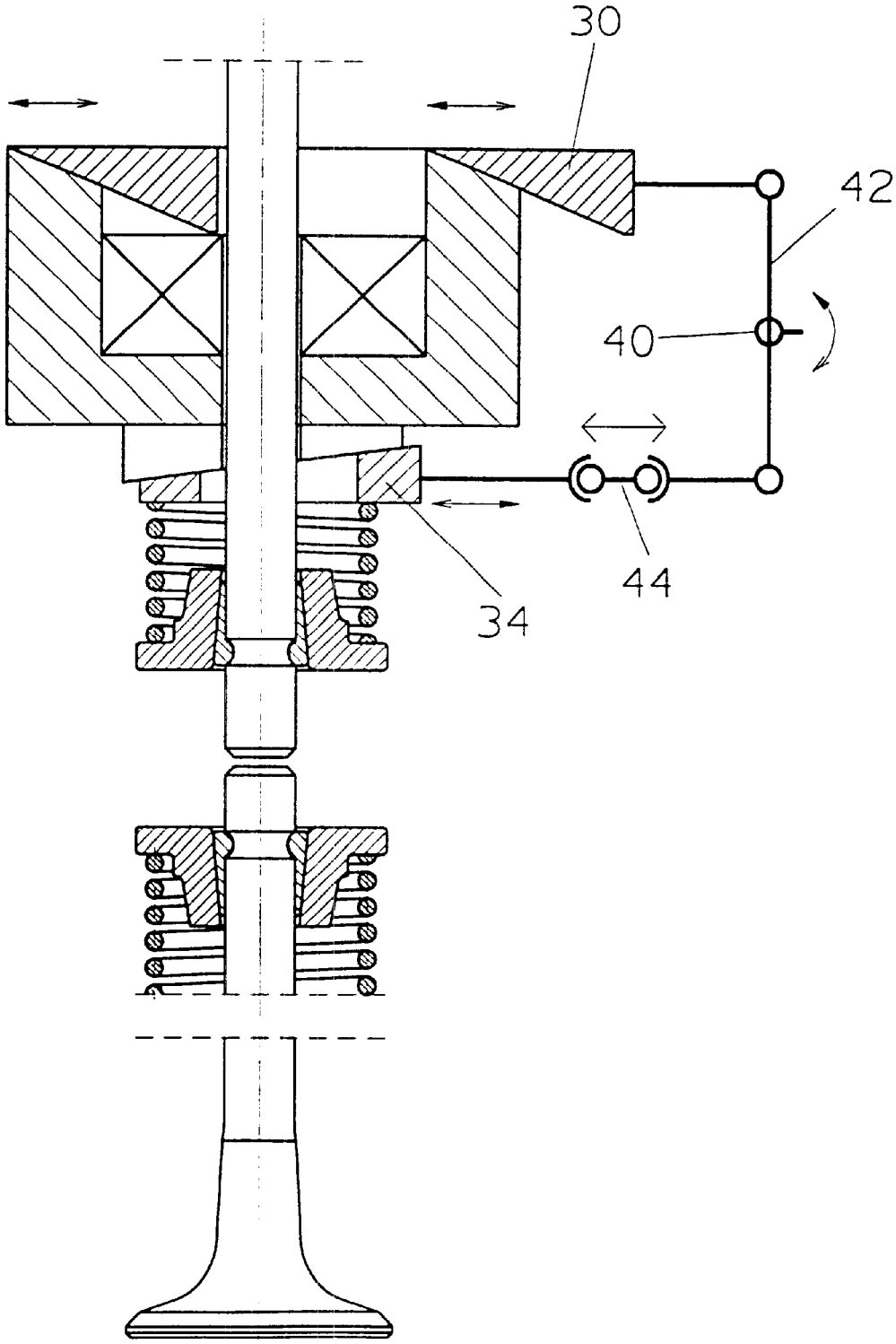
Figure 7:
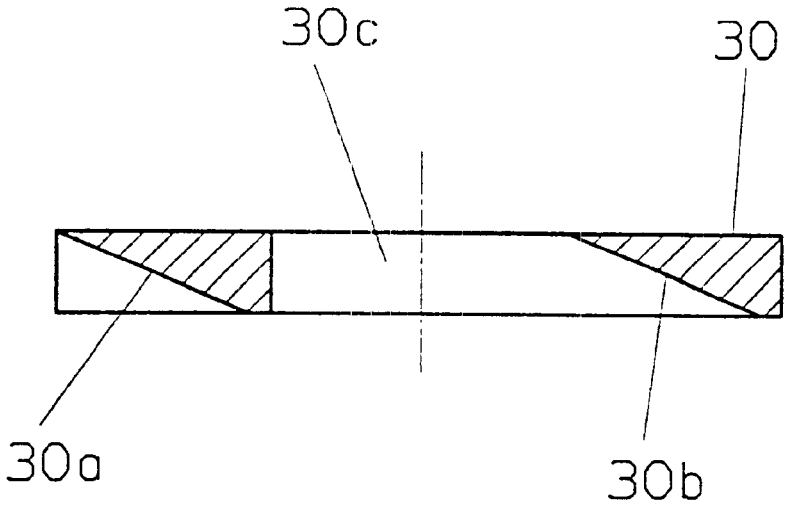
Figure 8:
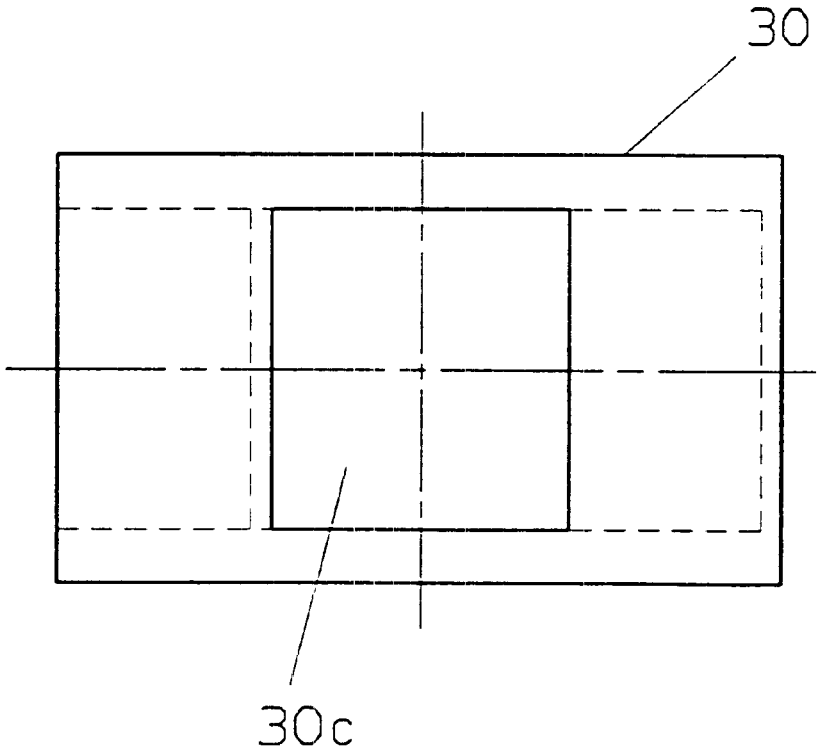
Figure 9:
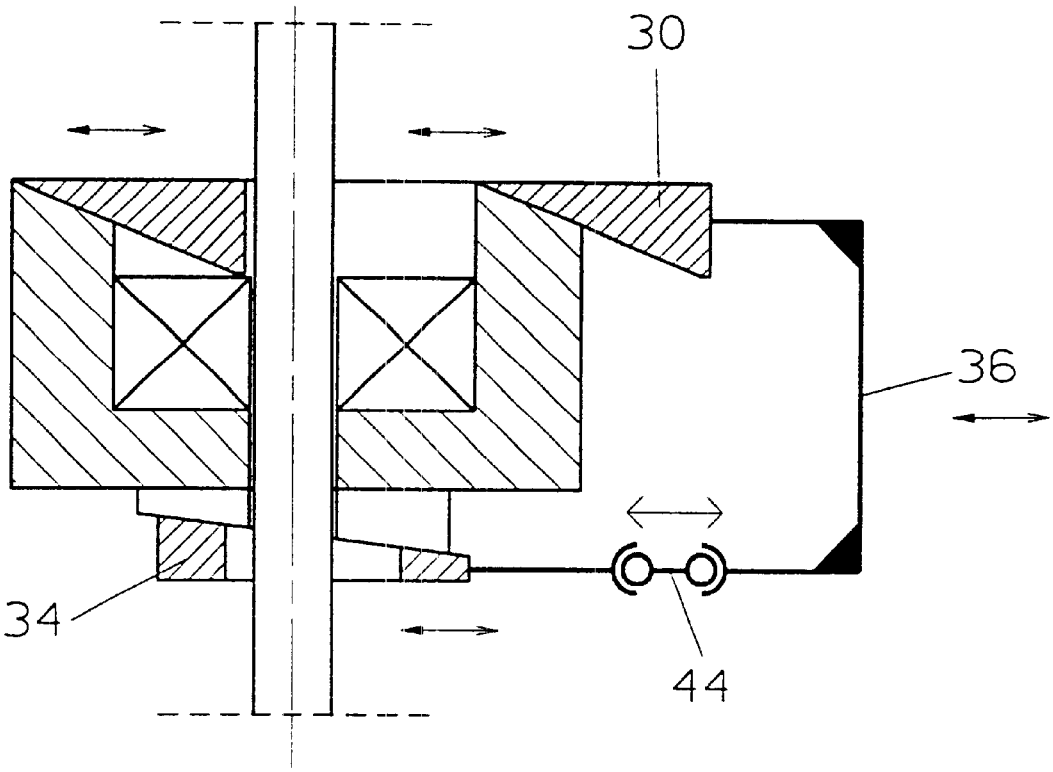

FIG. 1 a schematic sectional view of a device for actuating a gas shuttle valve;

FIG. 2 a schematic diagram of the device in a first adjustment state;

FIG. 3 a schematic diagram of the device in a second adjustment state;

FIG. 4 a schematic diagram of a modified embodiment of the device in a first adjustment state;

FIG. 5 a view analogous to FIG. 4 in a second adjustment state;

FIG. 6 a schematic diagram of another embodiment of the device;

FIG. 7 a schematic side view of an adjustment slide, shown in a sectional view;

FIG. 8 the adjustment slide of FIG. 7 in a top view;

FIG. 9 a schematic diagram of another embodiment; and

Figure 10:
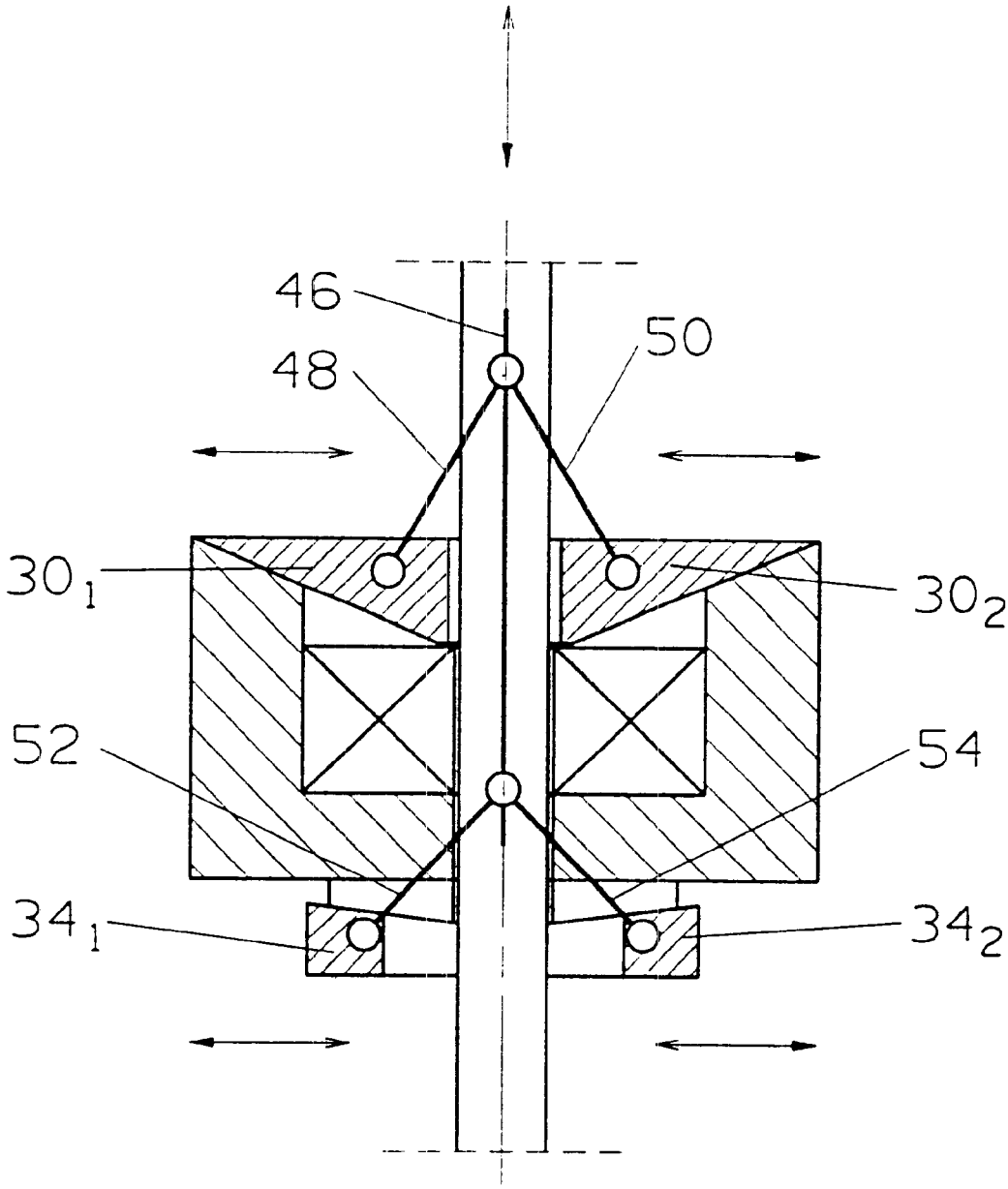

FIG. 10 a schematic diagram of an embodiment of an actuating drive for the device.

DETAILED DESCRIPTION OF THE INVENTION

FIG. 1 shows a valve stem X of a gas shuttle valve for an internal combustion engine in a cut-away view. In the position shown in FIG. 1, an actuating rod 10 has an end in abutment with the upper said face of the valve stem X. A drive element, i.e. an anchor plate 12, is rigidly attached to the actuating rod 10. The anchor plate 12 extends perpendicularly to the axis of the valve stem X and to the axis of rod 10 that is coaxial thereto. Electromagnetic actuators 14 and 16, respectively, are located on each of the two opposite sides of the anchor plate 12. The actuators 14, 16 are at a distance from each other in the axial direction of the valve stem. Each actuator 14, 16 has a winding 18, 18*a* and a magnet yoke 20, 20*a* surrounding the winding. The generally pot-shaped magnet yoke 20, 20*a* is surrounded by a housing 22, 22*a*. The anchor plate 12 is situated between the pole surfaces of the magnet yokes 20, 20*a*. One end of rod 10 is provided with a spring plate 11 on which a helical return spring 24 is supported. The actuators 14, 16 are arranged coaxially to rod 10, which passes axially through actuators 14, 16.

One of the two actuators, in FIG. 1 the lower actuator 16, can be arranged so as to move axially with respect to the other actuator, 14 in FIG. 1. For purposes of continuous adjustment of the stroke of anchor plate 12, there is a slide 30 that can be moved perpendicularly to the axis of rod 10 and that has two ramp surfaces 30*a*, 30*b*. Corresponding skewed surfaces on the yoke halves 20 and 20*a* of the actuator 16 are supported on the ramp surfaces 30*a*, 30*b*.

As an alternative, actuator 16 is stationary and actuator 14 is axially movable.

The end of the return spring 24 facing the actuators is supported on a buttress that is formed by a support wedge 32 whose ramp surface facing away from the return spring 24 is supported on a wedge-shaped slide 34. The slide 34 can also be moved perpendicularly to the axis of rod 10. Due to the movement of the slide 34, the support wedge 32 is raised or lowered in order to change the bias of the return spring 24.

If the valve is to assume a neutral position between an open valve position and a closed valve position while the actuators are at idle, a further return spring Y is provided in an opposite arrangement with respect to the return spring 24 on the valve shaft X to urge the valve stem X against rod 10.

The slides 30, 34 are rigidly coupled to each other by a bridge element 36 and they are synchronously moved by an actuating drive (not shown). The slide 34 has a ramp surface 34*a* that is slanted like the ramp surfaces 30*a*, 30*b* of the slide 30.

An adjustment screw Z serves to adjust the neutral position of the anchor plate 12.

Operation of the device is now explained with reference to FIGS. 2 and 3.

In the embodiment schematically shown in FIGS. 2 and 3, slide 30 complements magnet yoke 20*a* and is made of a ferromagnetic material. On the side of the slide 30 facing the anchor plate 12, slide 30 forms a pole surface; on its opposite side, it is provided with the ramp surfaces 30*a*, 30*b*. The magnet yoke 20*a* has correspondingly slanted support surfaces on which the ramp surfaces 30*a*, 30*b* bear slidingly. By moving the slide 30 perpendicularly to the axis of the valve shaft 10, the axial distance between the pole surfaces of the magnet yokes 20, 20*a* is changed.

In FIG. 2 and FIG. 3, anchor plate 12 abuts the pole surface of magnet yoke 20, corresponding to the open position of the gas shuttle valve. The lift of the gas shuttle valve according to FIG. 2 is set at the maximum value $H_1$, corresponding to the maximum distance between the anchor plate 12 and the pole surface of magnet yoke 20*a*. At the same time, return spring 24 is additionally stressed by the slide 34 and has an axial length $S_1$, corresponding to the distance between a spring plate 10*a* on the free end of the valve stem and the opposite buttress of return spring 24.

In FIG. 3, by adjustment of the slide 30, the pole surface of magnet yoke 20*a* is moved close to anchor plate 12 by the maximum possible value. The lift of the gas shuttle valve is reduced to the value $H_2$. In the extreme case, $H_2$=0 and the gas shuttle valve X remains closed. At the same time, due to the relief of the return spring 24 by synchronous adjustment movement of the slide 34, the axial length of the return spring 24 is increased to the value $S_2$. Consequently, in the opposite closed position of the gas shuttle valve, a constant return force of the return spring 24 is ensured, independent of the valve lift that has been set.

In the embodiment schematically shown in FIGS. 4 and 5, the slides 30 and 34 are each replaced by two slide or wedge members $\mathbf{30}_1$, $\mathbf{30}_2$ and $\mathbf{34}_1$, $\mathbf{34}_2$ respectively, which can be moved in the opposite directions. The slide members are moved towards each other or away from each other perpendicularly to the axis of the valve stem by means of an actuating drive. When the ramp surfaces of the slide members $\mathbf{30}_1$, $\mathbf{30}_2$ are slanted opposite to the slant of the corresponding ramp surfaces of the slide members $\mathbf{34}_1$, $\mathbf{34}_2$, as shown in FIGS. 4 and 5, movement of the slide members $\mathbf{30}_1$, $\mathbf{30}_2$ has to be opposite from movement of the slide members $\mathbf{34}_1$, $\mathbf{34}_2$. FIG. 4, analogously to FIG. 2, shows the setting to the maximum lift $H_1$, and FIG. 5, analogously to FIG. 3, shows the setting to the minimum lift $H_2$.

Even if the same actuating drive is used to change the lift of the gas shuttle valve and to adjust the bias of the return spring, lift and bias can be varied relative to each other. In the embodiment shown in FIG. 6, reference numeral 40 designates an actuating drive that performs a pivotal movement of a two-armed adjusting lever 42. The slide 30 is attached to one end of the lever 42 and the slide 34 is attached to the other end. In this embodiment, the slides 30, 34 move in opposite directions. The ratio of the movement strokes of the slides 30, 34 is determined by the position of the actuating drive 40 between the ends of the two-armed lever 42. A double arrow between the two-armed lever 42 and the slide 34 indicates that, in the actuating path to the slide 34, there can be another actuating means 44 that can be used to change the position of slide 34.

FIG. 7 shows the slide 30 in a cross-sectional side view; FIG. 8 shows a corresponding top view. Between the two slide members on which the ramp parts 30*a*, 30*b* are formed, there is a recess 30*c* through which rod 10 passes.

As an alternative to FIG. 6, FIG. 9 shows an embodiment analogous to FIGS. 2 and 3, in which the slides 30, 34 are moved in the same direction. Like in FIG. 1, they are coupled to each other by a bridge member 36 and, via the latter, to a shared actuating drive. In the actuating path between the bridge member 36 and the slide 34, there is an actuating member 44 with which the bias force of the return spring 24 can additionally be changed.

FIG. 10 shows an embodiment of an actuating drive with an adjusting rod 46 that can be reciprocated parallel to the axis of rod 10 and of valve shaft X. The adjustment rod 46 is coupled via articulated links 48, 50 to slide members $\mathbf{30}_1$, $\mathbf{30}_2$, which can be moved in opposite directions, and via further articulated links 52, 54 to the slide members $\mathbf{34}_1$, $\mathbf{34}_2$, which can likewise be moved in the opposite directions.

What is claimed is:

1. A device to actuate a gas shuttle valve in an internal combustion engine, having a drive element that acts on a valve stem by moving the valve stem across a valve lift in an axial direction, two actuators, one of the two actuators being located on each side of the drive element at a distance from each other in the axial direction and at least one return spring, the valve lift being variable by adjusting the distance between the actuators, at least one of the actuators having at least one skewed surface bearing axially on a corresponding ramp surface on a wedge which can be moved transversely to the axial direction, and movement of the wedge transversely to the axial direction causing the valve lift to be varied continuously.

2. The device according to claim 1, wherein the return spring is supported on a buttress that can be adjusted axially for maintaining a consistent spring force in the closed position of the valve independent of the current value of valve lift.

3. The device according to claim 2, wherein adjustment of the axial distance of the actuators is linked with adjustment of the buttress.

4. The device of claim 1, wherein one of the actuators is supported axially on a pair of wedge members that have parallel ramp surfaces and are movable jointly transverse to the axial direction.

5. The device of claim 1, wherein one of the actuators is supported axially on a pair of wedge members that have ramp surfaces inclined to opposite directions and are movable simultaneously transverse to the axial direction and in mutually opposite directions.

6. The device according to claim 5, wherein the wedge members are connected to a slide that has a recess for passage of an actuating rod coupled to the drive element, the actuating rod acting on the valve stem.

7. The device according to claim 5, wherein said wedge members are each pivotally connected to a first end of a link that has a second end pivotally connected to an adjustment rod that is movable in the axial direction.

8. The device according to claim 1, wherein a ratio between the bias force of the return spring and the current valve lift can be variably adjusted.

9. The device according to claim 1, wherein the actuators are electromagnetic and the drive element is an anchor plate located between magnet yokes of the electromagnetic actuators.

10. The device according to claim 9, wherein the yoke has at least one ramp surface opposite the anchor plate and bearing on a corresponding ramp surface of a wedge member of a magnetically permeable material.

11. A device to actuate a gas shuttle valve in an internal combustion engine, having a drive element that acts on a valve stem by moving the valve stem across a valve lift in an axial direction, two actuators, one of the two actuators being located on each side of the drive element at a distance from each other in the axial direction and at least one return spring, wherein the valve lift is variable by adjusting the distance between the actuators, wherein the return spring is supported on a buttress that can be adjusted axially for maintaining a consistent spring force in the closed position of the valve independent of the current value of valve lift, wherein the buttress is supported on at least one ramp surface on a wedge that can be moved transversely to the axial direction.

12. The device according to claim 11, characterized in that the ramp surface associated with the actuator and the ramp surface associated with the buttress are each formed on one of a pair of wedge members that are linked for joint movement transverse to the axial direction.

13. The device according to claim 12, wherein the wedge member is connected to a slide that has a recess for passage of an actuating rod coupled to the drive element, the actuating rod acting on the valve stem.

* * * * *